United States Patent [19]

Warren et al.

[11] Patent Number: 4,705,117

[45] Date of Patent: Nov. 10, 1987

[54] METHOD AND APPARATUS FOR REDUCING DRILL BIT WEAR

[75] Inventors: Tommy M. Warren, Coweta; Warren J. Winters; J. Ford Brett, both of Tulsa, all of Okla.

[73] Assignee: Amoco Corporation, Chicago, Ill.

[21] Appl. No.: 801,167

[22] Filed: Nov. 22, 1985

[51] Int. Cl.[4] ..... E21B 4/02; F03B 13/02

[52] U.S. Cl. ..... 175/65; 175/107; 415/502

[58] Field of Search ..... 175/65, 107, 106, 100, 175/101, 321, 324, 323, 92, 93; 415/502

[56] References Cited

U.S. PATENT DOCUMENTS

| | | | |
|---|---|---|---|
| 2,865,602 | 12/1958 | Whittle | 175/107 |
| 4,019,592 | 4/1977 | Fox | 175/321 X |
| 4,058,163 | 11/1977 | Yandell | 175/107 X |
| 4,295,535 | 10/1981 | Crase et al. | 175/101 |
| 4,427,079 | 1/1984 | Walter | 175/106 |

FOREIGN PATENT DOCUMENTS

| | | | |
|---|---|---|---|
| 2332412 | 6/1977 | France | 175/107 |

*Primary Examiner*—Stephen J. Novosad
*Assistant Examiner*—David J. Bagnell
*Attorney, Agent, or Firm*—Scott H. Brown; Fred E. Hook

[57] ABSTRACT

A turbine for driving a drill bit includes means for locking the turbine rotor. A generally cylindrical locking assembly is connected to the rotor via a splined connection which permits relative axial movement of the locking assembly and rotor while restricting relative rotational movement thereof. A tab extends radially outwardly from the locking assembly and is receivable in an axial groove formed on the inner surface of the turbine case. When so received, rotational movement of the locking assembly and thus the rotor is prevented. An annular cavity is formed on the inner surface of the turbine case adjacent one end of the groove. When the tab is received therein, rotational movement of the locking assembly and rotor relative to the turbine case is permitted. A wellbore may be reamed and washed with the rotor in its locked condition by rotating the drill string as in conventional rotary drilling and circulating fluid.

21 Claims, 10 Drawing Figures

METHOD AND APPARATUS FOR REDUCING DRILL BIT WEAR

BACKGROUND OF THE INVENTION

1. Field of the Invention

The present invention relates to methods and apparatus for reducing drill bit wear and more particularly to such a method and apparatus which reduces the wear on a turbine-driven drill bit being lowered into a wellbore.

2. Setting of the Invention

A common configuration for drilling wells includes a drill bit suspended from a string of drill pipe. Often, the drill bit includes openings in the lower end thereof to enable circulation of drilling fluid down the pipe string, through the bottom of the bit, and upwardly into the annulus between the outer surface of the pipe string and the wellbore. In conventional rotary drilling, the drill string is rotated while the fluid circulation flushes cuttings from the bottom of the wellbore and cools the drill bit.

In another form of drilling, a cylindrically-shaped downhole hydraulic motor is suspended from the lower end of a string of drill pipe and a drill bit having openings in the lower end thereof is mounted on a tubular drive shaft which extends from the lower end of the motor. Fluid is circulated down the drill string and through the motor thereby rotating the drive shaft. Fluid flow continues through the drive shaft, out the bottom of the bit and into the annulus. Thus, the fluid powers the downhole motor and, as in conventional rotary drilling, flushes cuttings from the bottom of the hole and cools the drill bit during drilling.

During the drilling of a well, it is usually necessary to periodically change the drill bit. The number of drill bits needed to complete the bore is dependent upon the hardness of the rock and the depth of the bore. When it is necessary to change the bit, the drill pipe is lifted out of the bore until the motor and bit are at the surface. A new bit is then mounted on the lower end of the motor and the string of drill pipe, with the motor and bit on the lower end thereof, is lowered into the wellbore.

When lowering a bit into a wellbore, it is sometimes desirable to rotate the bit to ream the bore. If the bit is not rotated and it should encounter an obstruction, e.g., a rock ledge or an undersize portion of the bore, the weight of the drill string on the bit could deform or otherwise damage the bit. In order to prevent such from occurring, the bit may be rotated thereby reaming the bore during downward travel.

One type of downhole motor which may be used to drive the drill bit is a turbine. The turbine experiences its maximum speed, which may be two or three thousand revolutions per minute or higher, under a no-load condition. Thus, when reaming a bore as described above, the turbine is likely to be rotating the drill bit at maximum speed. As the drill string is lowered, the bit is loaded only on its outer portion or gage area as the bore is reamed. If the gage area should strike a protruding rock ledge or the like under such conditions, the bit may be excessively worn or, in the worst case, broken.

It is not uncommon for the lower portion of the bore to be filled with dirt and rock rubble. Such rubble results from caving in of the bore walls during the trip out and from cuttings generated by reaming on the trip back in. Even if it is not necessary or desirable to ream a bore, it is important to begin circulation through the drill string above the rubble. Such circulation flushes the rubble upwardly in the annulus between the bore and the drill string and thus exposes the bottom of the bore for continued drilling. When circulation is started, the drill bit begins turning at a high rate of speed and may suffer damage or increased wear as described above.

There exists a need for a method and apparatus for reducing drill bit wear. Moreover, there exists a need for such a method and apparatus which reduces the wear on a turbine-driven drill bit while it is being lowered in a wellbore.

SUMMARY OF THE INVENTION

The present invention comprises a novel method and apparatus for reducing wear on a turbine-driven drill bit by preventing turbine rotation while circulating drilling fluid as the drill string is lowered in a wellbore. One aspect of the apparatus of the invention includes a locking assembly slidably mounted on the turbine rotor. A splined connection between the rotor and locking assembly permits axial movement of the locking assembly relative to the rotor while restricting relative rotational movement. A tab extends axially outwardly from the locking assembly. The inner surface of the turbine case includes an axial groove which prevents rotation of the locking assembly when the tab is received therein. An annular cavity is formed on the inner surface of the turbine adjacent one end of the groove. When the tab is received in the cavity, the locking assembly is rotatable relative to the turbine case.

In using the apparatus of the invention, the drill string may be rotated while the turbine is locked against rotational movement thereby reaming the bore as in conventional rotary drilling. While the rotor is so locked, fluid may be circulated to wash the bottom of the bore without rotating the rotor relative to the turbine case.

The present invention is particularly useful for preventing wear on a turbine-driven drill bit while the bit is lowered in a wellbore.

DETAILED DESCRIPTION OF THE PREFERRED EMBODIMENTS

The present invention provides a method and apparatus for reducing wear on a turbine-driven drill bit while the bit is being lowered in a wellbore. In one aspect of the apparatus of the invention, a locking assembly is slidably mounted on the turbine rotor coaxially therewith. A splined connection is formed between the locking assembly and the rotor to permit relative axial movement while restricting relative rotational movement thereof. A tab extends radially outwardly from the locking assembly and may be received in an axial groove formed on the inner surface of the turbine case. When so received, the locking assembly is restrained against rotational movement. An annular cavity is formed in the radially inner side of the turbine case at one end of the groove and when the tab is received therein, rotational movement of the locking assembly is permitted.

Figure 1:
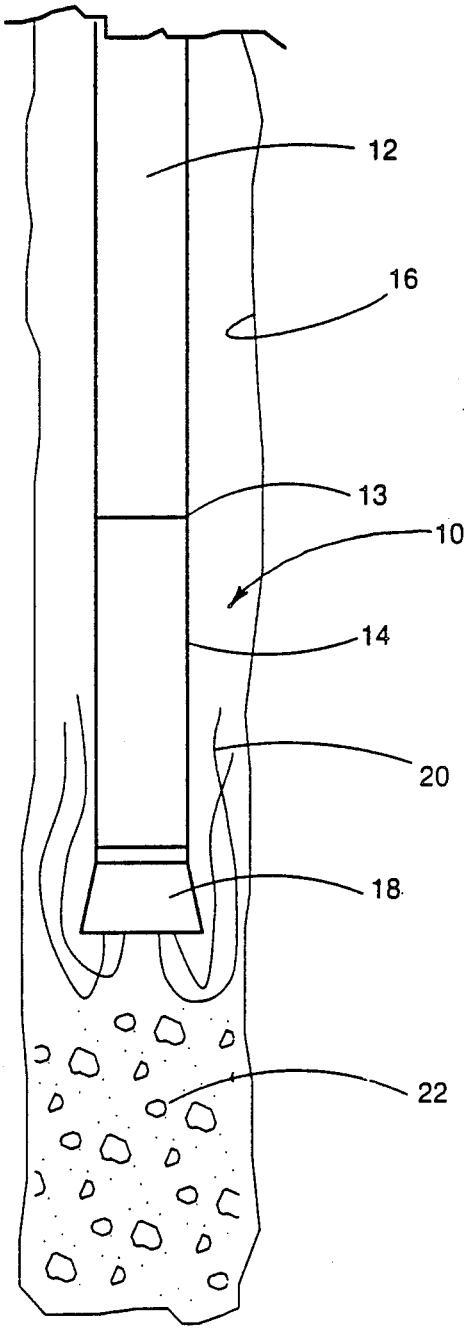
FIG. 1 is an elevational view of a preferred embodiment of the apparatus of the invention suspended from a string of drill pipe in a wellbore.

Indicated generally at 10 in FIG. 1 is apparatus constructed in accordance with the instant invention. Included therein is a string of drill pipe 12 having a turbine 14 suspended from the lower end thereof via threaded connection 13. The drill pipe and turbine are received within a wellbore 16 and are being lowered therein. Mounted on the lower end of turbine 14 is a commercially available drill bit 18. Fluid 20 is circulating down through drill string 12, turbine 14, and out the lower end of drill bit 18. The fluid rotates the rotor (not visible in FIG. 1) of turbine 14, upon which the drill bit is mounted, and also cools the drill bit and flushes cuttings upwardly in the annulus between drill string 12 and the wellbore during drilling.

Dirt and rock rubble 22 fills the lower portion of the bore. Such accumulates as a result of caving in of the walls of the bore. Fluid 20 washes away rubble 22 as drill string 12 is lowered to place drill bit 18 on the bottom of the bore. As fluid 20 leaves the lower end of drill bit 18, rubble 22 is flushed into the annulus between the drill string and the wellbore and from there to the surface.

Figure 2:
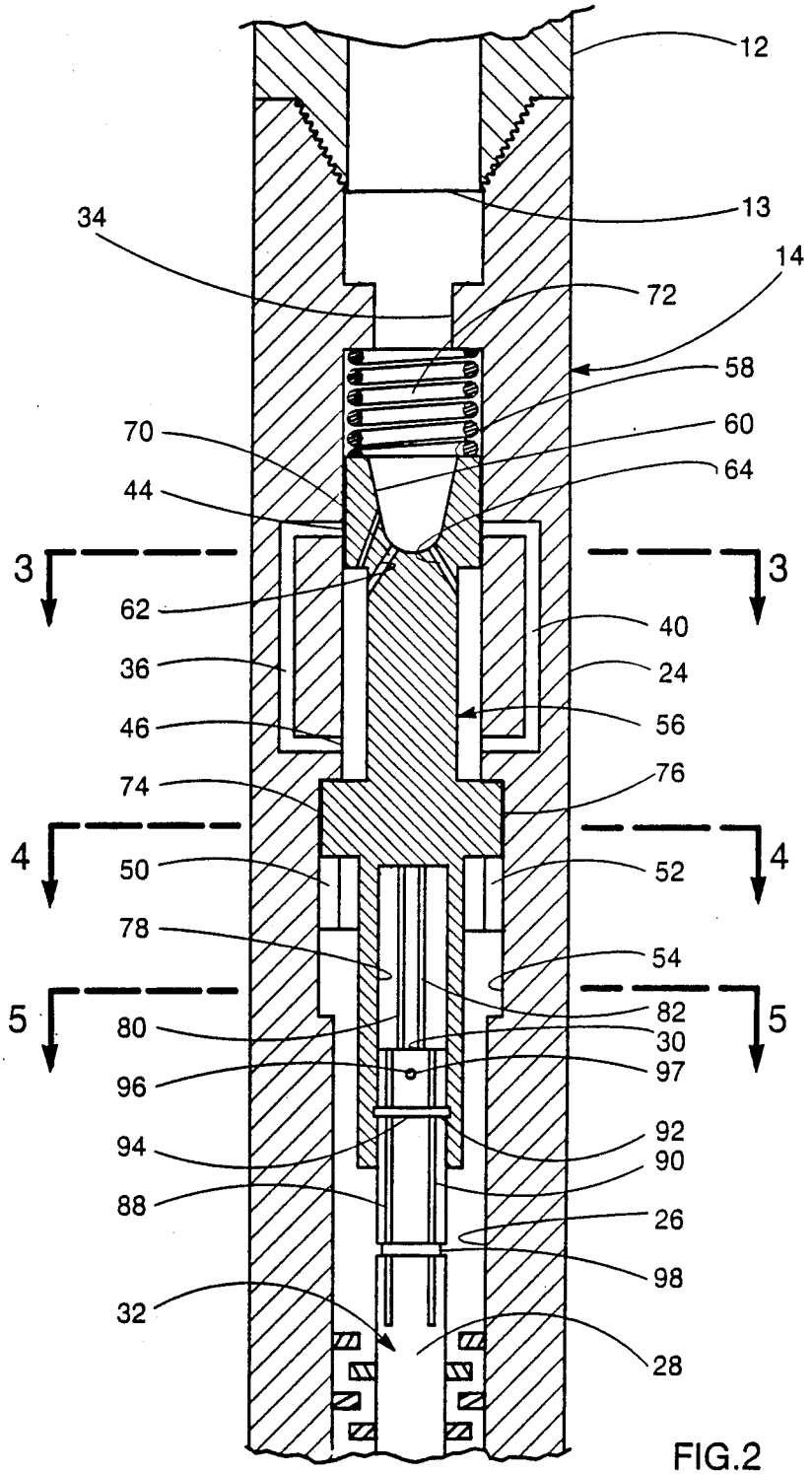
FIG. 2 is an enlarged, partially cross-sectional view of the embodiment of FIG. 1 with the locking assembly in its first axial position.
Figure 3:
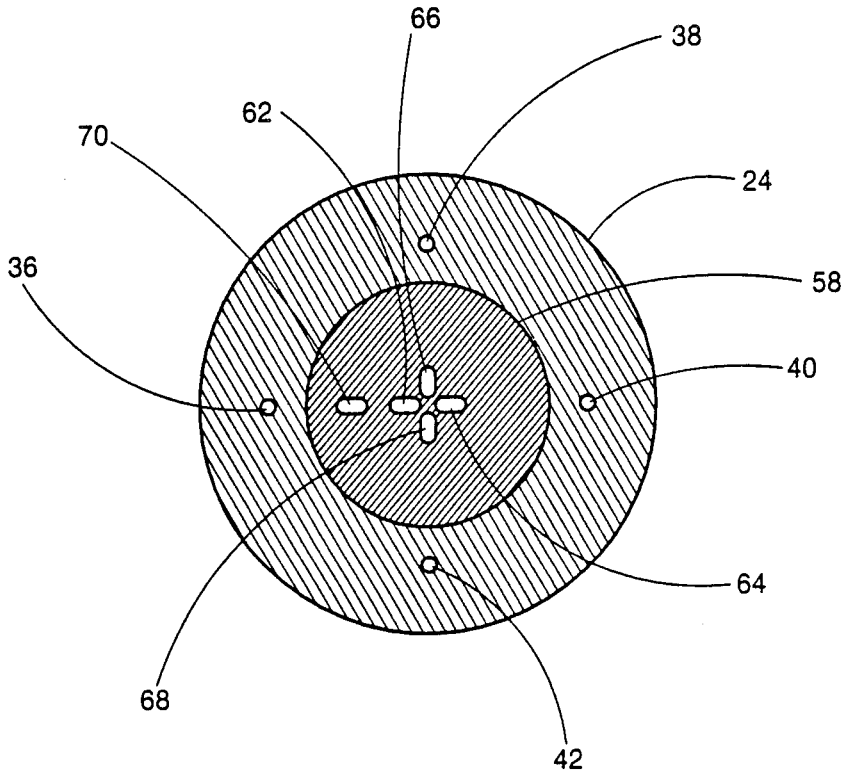
FIG. 3 is a cross-sectional view taken along lines 3—3 in FIG. 2.
Figure 4:
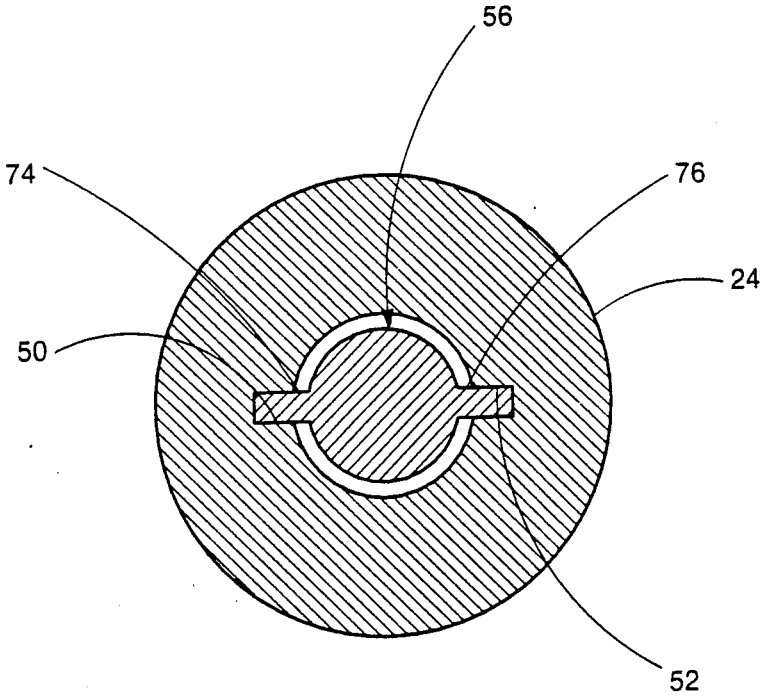
FIG. 4 is a cross-sectional view taken along lines 4—4 in FIG. 2.

Turning now to FIG. 2, turbine 14 includes a turbine case 24 which at its upper end is connected via threaded connection 13 to drill pipe string 12. The turbine case includes a generally cylindrically bore 26 therethrough into which a rotor 28 is received. The rotor includes an upper end 30 and a lower end (not visible in FIG. 2) which extends from the lower end of the turbine case and upon which drill bit 18 is mounted. Rotor 28 is mounted on bearings (not visible) in the usual manner to permit rotational movement, but not longitudinal movement of the rotor. A plurality of vanes, indicated generally at 32 are mounted on the radially outer surface of the rotor and the radially inner surface of the turbine case and cause the rotor to rotate relative to the turbine case when fluid is circulated downwardly through bore 26.

Figure 5:
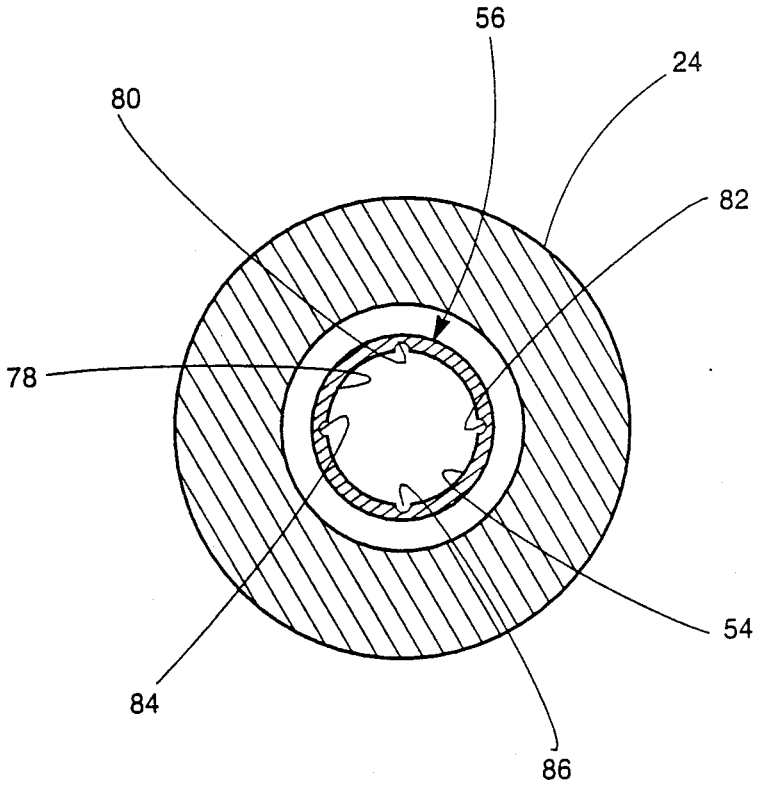
FIG. 5 is a cross-sectional view taken along lines 5—5 in FIG. 2.

The lower end of locking assembly 56 includes a bore 78 into which rotor 28 is received. Bore 78 includes four axial grooves 80, 82, 84, 86 (in FIGS. 2 and 5) along the length thereof. Grooves 80–86 each receive an axial ridge, like ridges 88, 90, which extend outwardly from rotor 28. Ridges 88, 90 are received within grooves 84, 86, respectively while the ridges on the other side of rotor 28 (not visible) are received in grooves 80, 82. Bore 78 includes a groove 92 formed on its radially inner surface about the circumference thereof. An expandable ring 94 of the type known as a snap ring is received within groove 92 and rotor 28 is in turn received through ring 94. Rotor 28 is connected to locking assembly 56 by a shearable pin 96 which is received within a radial bore 97 formed through rotor 28 and a corresponding radial bore formed through the locking assembly. Rotor 28 includes a groove 98 formed on the radially outer surface of the rotor about the circumference thereof. The position of locking assembly 56 relative to turbine case 24 is referred to herein as a first axial position.

In operation of the embodiment shown in FIGS. 1–7, when turbine 14 is at the surface, it is placed in the configuration shown in FIG. 2. That is, locking assembly 56 is moved upwardly thereby compressing spring 72 between upper portion 58 and shoulder 34. When the locking assembly is in the position shown in FIG. 2, bore 97 in rotor 28 is aligned with the radial bore (not visible) through the locking assembly. Shear pin 96 is inserted through the radial bores in the rotor and locking assembly thereby maintaining the locking assembly in the position shown. Thereafter, turbine 14, which is suspended from drill string 12, is lowered into the wellbore. During such lowering, it may be desirable to rotate drill string 12 as is done in conventional rotary drilling to ream wellbore 16 with bit 18 as the drill string is lowered. Such reaming is typically done at speeds of less than 100 revolutions per minute which are sufficient to ream the bore, but which would not damage drill bit 18 in the event an obstruction, e.g., a rock ledge or a narrowed portion of the bore, is encountered.

During lowering of the drill string it may be desirable to circulate fluids through the drill string, turbine and drill bit. Such is especially desirable to wash rubble 22 from the bottom of the wellbore as the drill bit approaches the bottom as shown in FIG. 1. When fluid is circulated, it passes from drill string 12 into bore 26 in the turbine case. The fluid continues downwardly through bores 62–70 in locking assembly 56, through the annulus between the locking assembly and bore 26 and further downwardly into the annulus between rotor 28 and bore 26. Since tabs 74, 76 are received within grooves 50, 52, locking assembly 56 is not free to rotate. Since the axial ridges, like ridges 88, 90, on rotor 28 are each received within a different one of grooves 80–86, rotor 28 is restrained against rotational movement relative to locking assembly 26. Therefore, fluid passing vanes 32 does not rotate the rotor and hence the drill bit is restrained from rotational movement relative to turbine case 24.

Circulation of fluids and rotation of drill string 12 continues as described above until rubble 22 is washed from the bottom of the bore and drill bit 18 is resting on the bottom. When such occurs, a ball 100 (in FIG. 6) is dropped into drill string 12 and descends therein until it comes to rest in recess 60 over bores 62–68. Thus, ball 100 prevents the circulation of fluids through bores 62–68. Since ball 100 is of a size to just cover bores 62–68 and leave uncovered the upper end of bore 70, circulation continues through bore 70. Bore 70 is sized to cause a substantial pressure drop thereacross when the other four bores are blocked by ball 100. Accordingly, the fluid causes downward pressure on locking assembly 56 which ultimately shears pin 96. When the pin is sheared, fluid pressure and spring 72 force locking assembly 56 downwardly to the position of FIG. 6. This position is referred to herein as a second axial position.

Turbine case 24 includes an annular shoulder 34 formed on the radially inner surface thereof near threaded connection 13. Four by-pass bores 36, 38, 40, 42 (in FIGS. 2 and 3 with only bores 36, 40 being viewable in FIG. 2) are formed in turbine case 24. Each of the bores includes an upper port, like port 44 for bore 36, and a lower port, like port 46, which provide fluid communication through their associated by-pass bores between bore 26 adjacent the upper port and between bore 26 adjacent the lower port.

Beneath the by-pass ports, turbine case 24 includes a pair of axial grooves 50, 52. Grooves 50, 52 are perhaps best viewed in FIG. 4. Immediately beneath grooves 50, 52, and in communication therewith, is an annular counterbore 54, also referred to herein as an annular cavity. Counterbore 54 is also viewable in FIG. 5.

A generally cylindrical locking assembly 56 is received within bore 26. Locking assembly 56 includes a substantially cylindrical upper portion 58 having a cup-shaped recess 60 formed therein. A helical spring 72 is compressed between shoulder 34 and upper portion 58. Four bores 62, 64, 66, 68 (in FIGS. 2 and 3) having substantially the same diameter provide fluid communication between bore 26 above recess 60 and the annulus between locking assembly 56 and bore 26 beneath upper portion 58. A fifth bore 70 having smaller diameter than bores 62–68 provides fluid communication between bore 26 above upper portion 58 and the annulus between locking assembly 56 and bore 26 as do bores 62–68. However, the upper end of bore 70 is at a higher elevation than the upper end of each of the other bores, the significance of which will be hereinafter explained.

A pair of tabs 74, 76 (in FIGS. 2 and 4) extend radially outwardly from locking assembly 56. In the configuration shown in FIGS. 2 and 4, tab 74 is received within groove 50 while tab 76 is received within groove 52.

Figure 6:
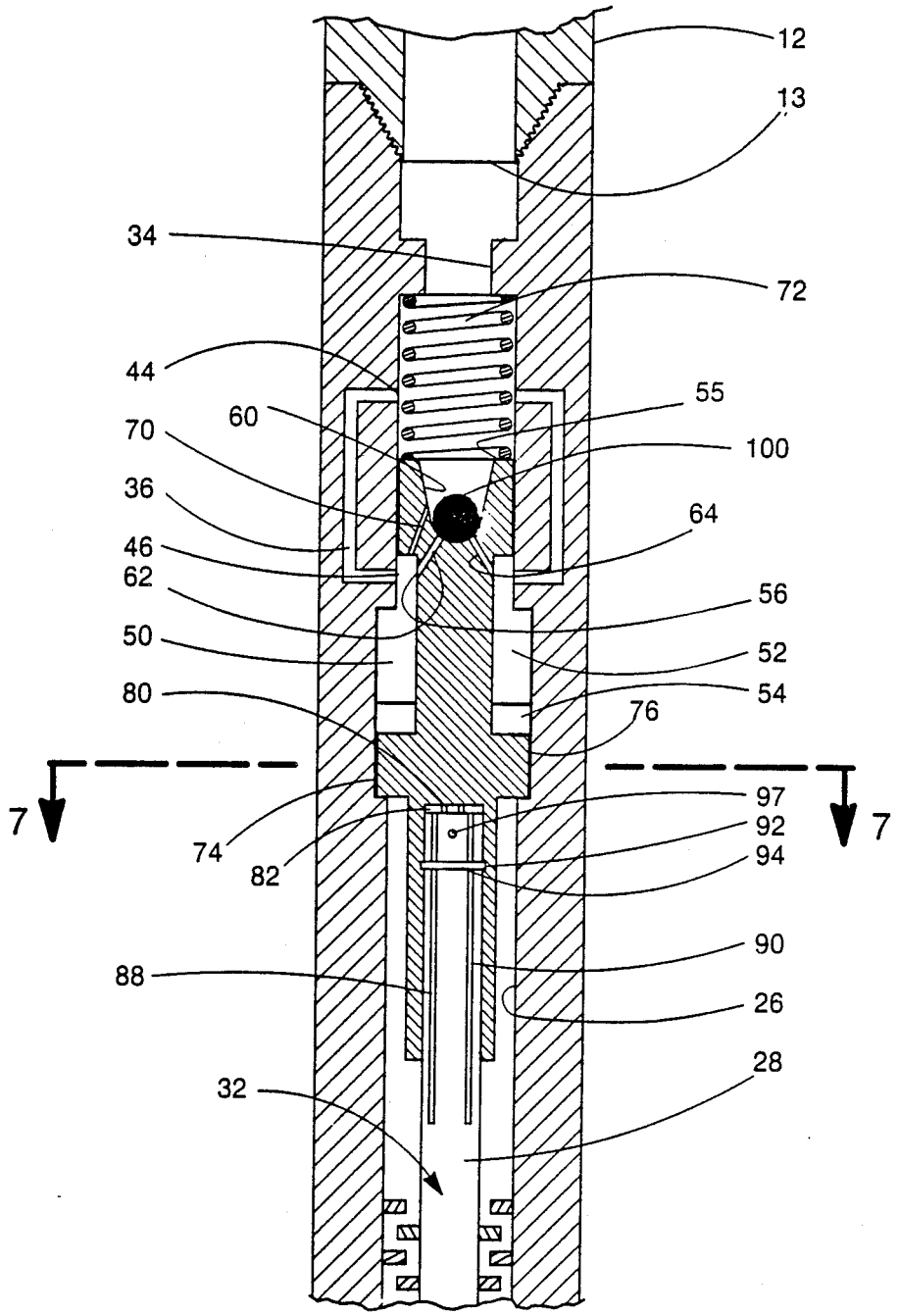
FIG. 6 is a view similar to FIG. 2 with the locking assembly in its second axial position.
Figure 7:
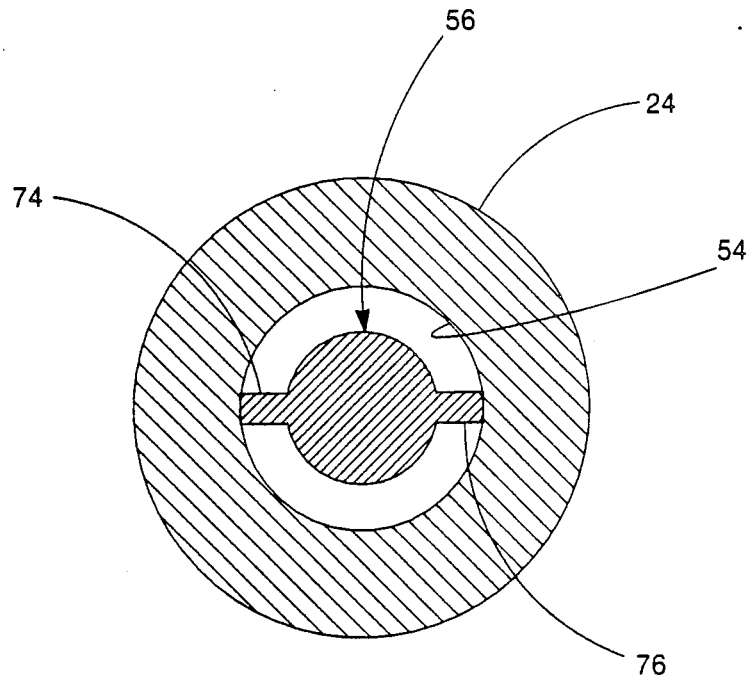
FIG. 7 is a view taken along lines 7—7 in FIG. 6.

In FIG. 6, tabs 74, 76 are received within cavity 54 thus freeing locking assembly 56 to rotate relative to turbine case 24. When locking assembly 56 moves to its second axial position, ring 94 is received within groove 98 on rotor 28 thereby fixing the relative axial positions of the rotor and locking assembly as shown in FIG. 6. In the embodiment of FIGS. 1–7, turbine 14 must again be returned to the surface in order to change the configuration from that shown in FIG. 6 to that shown in FIG. 2.

Fluid circulates through drill string 12 and enters by-pass bores 36–42 at the top thereof and returns to bore 26 at the lower end of the by-pass bores thereby permitting fluid circulation around upper portion 58 of the locking assembly. Fluid continues downwardly in the annulus between the locking assembly and bore 26 and passes vanes 32 thereby rotating rotor 28 (and the locking assembly). Further downward flow through the drill bit flushes cuttings into the annulus and cools the bit during turbine-driven drilling.

In event that full circulation is not required during the lowering of turbine 14, bore 70 is eliminated or plugged and bores 62–68 are sized so that circulation at a lower flow rate may be achieved without raising the pressure above locking assembly 56 sufficiently to shear pin 96. Once the drill bit is on the bottom of the bore, the circulation flow rate may be increased to the point that the pressure above locking assembly 56 is sufficient to shear pin 96 thereby permitting movement to the configuration of FIG. 6 as previously described.

Figure 8:
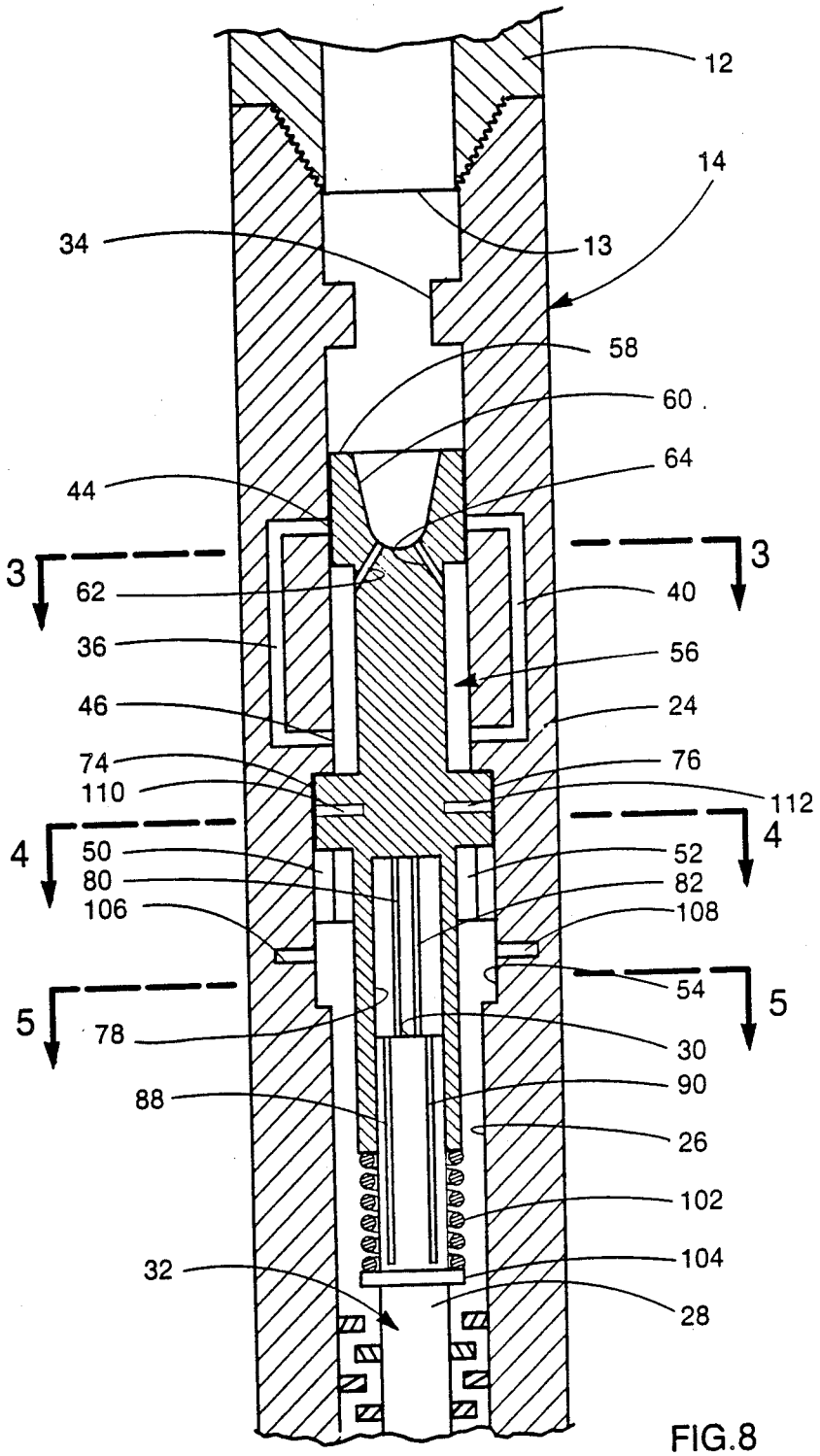
FIG. 8 is a view of another preferred embodiment of the invention similar to the view of FIG. 2 with the locking assembly in its first axial position.

Turning now to FIG. 8, consideration will now be given to the structure of a second embodiment of the apparatus of the invention. Structure in FIG. 8 which corresponds to previously-described structure bears the corresponding number. It will be noted that spring 72, shear pin 96, ring 94, and bore 70 are not included in the embodiment of FIG. 8. A spring 102 is constrained between the lower end of locking assembly 56 and an annular shoulder 104 formed about the circumference of rotor 28 with the rotor being received through the spring. A pair of radial bores 106, 108 are formed in turbine case 24 and communicate with the counter bore 54. A pair of radial bores 110, 112 are formed in tabs 74, 76. For a more detailed view of bore 112 and the structure received therein, attention is directed to FIG. 9. Received in bore 112 is a rod 114. Rod 114 is biased to the left in FIG. 9 by a spring 116 which has one end attached to the end of bore 112 and the other end attached to rod 114. A similar rod and spring is received within bore 110.

Figure 9:
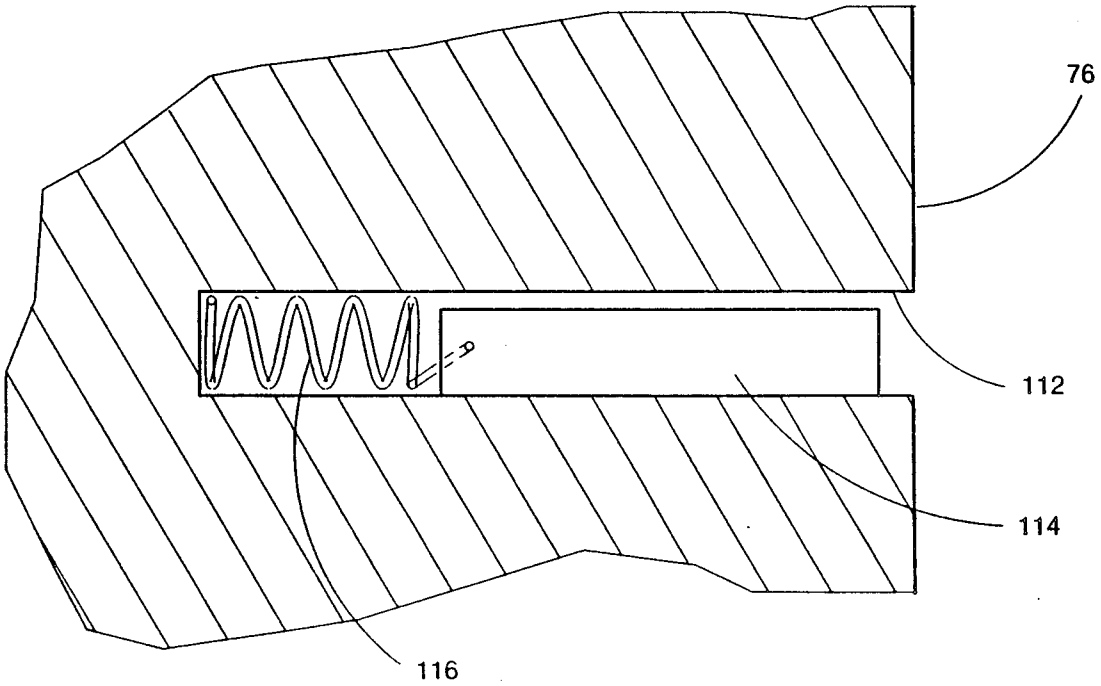
FIG. 9 is an enlarged, partially cross-sectional view of a portion of the embodiment shown in FIG. 8.
Figure 10:
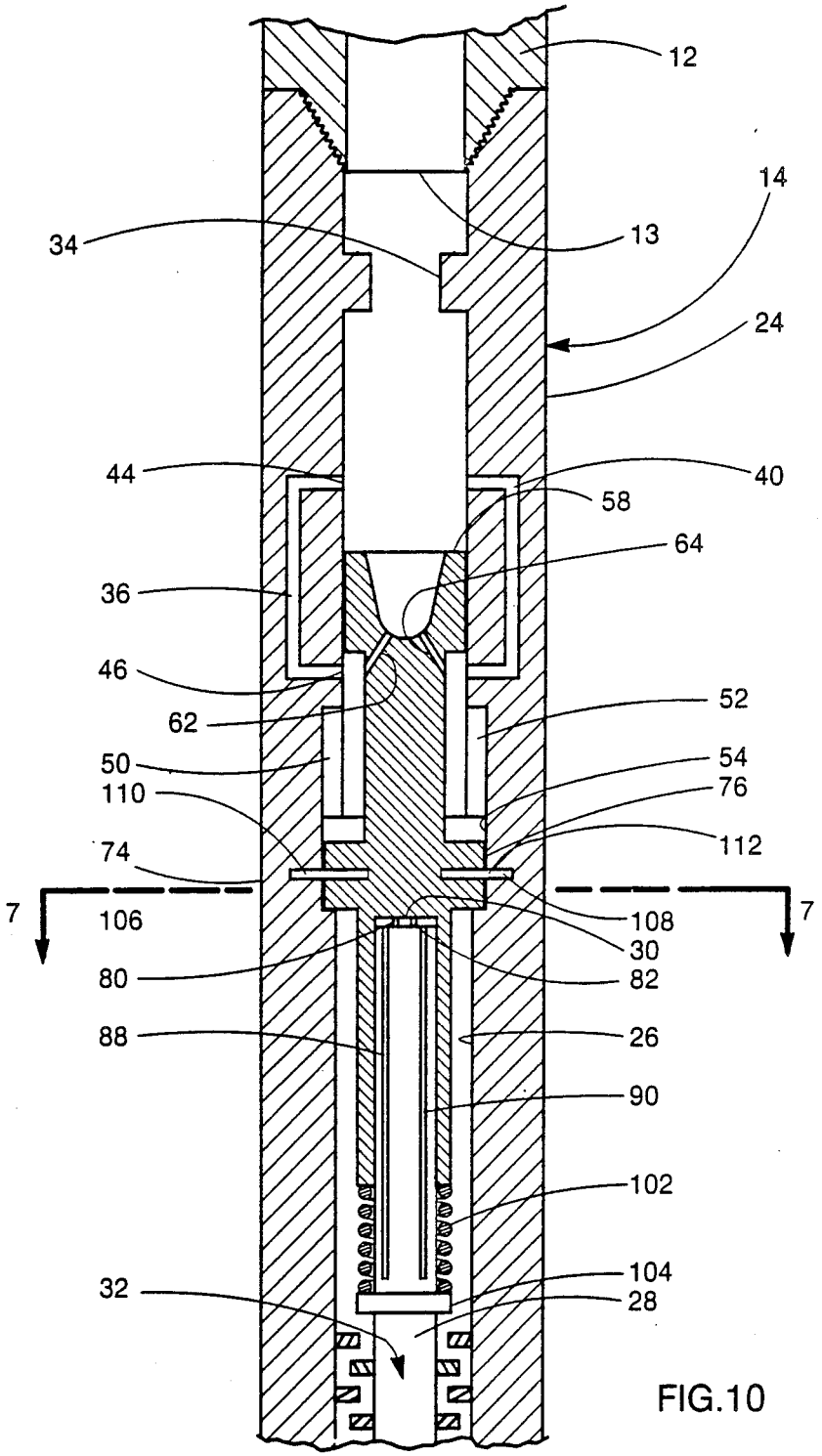
FIG. 10 is a view of the embodiment of FIG. 8 with the locking assembly in its second axial position.

In operation of the embodiment shown in FIGS. 8–10, bores 62–68 are sized and the strength of spring 102 is selected so that a reduced circulation rate may be achieved while the locking assembly remains in the position shown in FIG. 8. Thus, during reaming of the bore (by rotating the drill string) and/or washing the bottom, as has been previously described, circulation at a specified reduced level is possible without rotation of rotor 28 since, in the position of FIG. 8, tabs 74, 76 are received within grooves 50, 52 and thus restrain locking assembly 56 from rotation. As in the previously-described embodiment, grooves 80, 82 in bore 78 receive the ridges, like ridges 88, 90, on rotor 28 thus preventing rotor rotation relative to locking assembly 56.

When the rubble is washed from the bottom of the bore and/or the bore is reamed by rotation of drill string 12, drill bit 18 is placed on the bottom of the bore. Afterwards, fluid circulation is raised thus increasing the pressure drop across bores 62–68 and therefore the downward pressure acting on locking assembly 56. As pressure increases, the locking assembly compresses spring 102 and moves to its second axial position as shown in FIG. 10. As in the previously-described embodiment, fluid circulates around upper portion 58 through by-pass bores 36–42 and through the annulus between the locking assembly and bore 26. Since tabs 74, 76 are received in annular cavity 54, the locking assembly is free to rotate and does so as the fluid passes over vanes 32 thereby turning rotor 28. When a sufficient rotation rate is achieved, rod 114 and the opposing rod in bore 110 partially extend from the bores in which they are received into their associated opposing bores in the turbine case. Thus, the rods prevent axial movement of the locking assembly relative to turbine case 24 during drilling. Such prevents accidental engagement of tabs 74, 76 with grooves 50, 52, during drilling operations due to bouncing of the turbine. When it is desired to re-engage the locking assembly to prevent rotor movement, drilling fluid circulation rate is lowered thus reducing the rate of rotation of the rotor and permitting the rods received in bores 110, 112 to be withdrawn, under the action of the springs, like spring 116, back into bores 110, 112. As the circulation flow rate is reduced, the pressure drop across the locking assembly is likewise reduced thus enabling upward movement of the locking assembly under action of spring 102. At some point, flow rate is sufficiently reduced to permit tabs 74, 76 to be re-engaged with grooves 50, 52, thus locking the rotor against rotational movement.

Thus the present invention is well adapted to obtain the advantages mentioned, as well as those inherent therein. It is to be appreciated that revisions or modifications may be made to the methods and apparatus disclosed herein without departing from the spirit of the invention which is defined in the following claims.

What is claimed is:

1. A method for using a drill bit of the type which is mounted on a rotor of a turbine suspended from a string of drill pipe comprising the steps of:

locking the rotor prior to lowering the turbine and drill bit into the wellbore to prevent rotation of the drill bit thereby reducing wear on the drill bit as the turbine and drill bit are lowered into the wellbore;

lowering the locked turbine and drill bit into the wellbore; and unlocking the rotor of the turbine to permit rotation of the drill bit prior to drilling.

2. The method of claim 1 wherein the step of lowering the turbine into a wellbore comprises lowering the turbine until the drill bit is on the bottom of the wellbore.

3. The method of claim 1 wherein the steps of lowering the turbine into a wellbore and circulating drilling fluid through the drill pipe, turbine, and bit are performed simultaneously.

4. The method of claim 1 which further comprises the step of rotating the string of drill pipe during the step of lowering the turbine into a wellbore.

5. The method of claim 1 wherein the rotor is locked by circulating drilling fluid through the drill pipe, turbine, and bit.

6. Apparatus for reducing wear on a drill bit of the type which is mountable on a rotor of a turbine, said rotor received within a turbine case, comprising a locking assembly capable of rotating relative to the turbine case, whereby the rotor can be locked as the turbine and drill bit are lowered into the wellbore and the rotor can be unlocked prior to drilling.

7. The apparatus of claim 6 wherein said apparatus further includes means for selectively locking and unlocking said rotor responsive to variations in turbine fluid pressure.

8. The apparatus of claim 7 wherein said apparatus further includes means for maintaining said rotor in its unlocked condition during rotation of said rotor.

9. The apparatus of claim 6 wherein said apparatus further includes means for unlocking the rotor to permit rotation thereof.

10. The apparatus of claim 9 wherein said apparatus further includes means for maintaining said rotor in it unlocked condition.

11. The apparatus of claim 9 wherein said apparatus further includes a locking assembly mounted on top of said rotor coaxially therewith, said locking assembly having a first axial position relative to said rotor in which rotation of said rotor is prevented and a second axial position relative to said rotor in which rotation of said rotor is permitted.

12. A turbine suspended from a string of drill pipe comprising a generally cylindrical turbine case having an interior cavity in communication with the upper and lower ends of said case, a rotor received within said cavity, and a locking assembly capable of rotating relative to the turbine case, whereby the rotor can be locked as the turbine is lowered into the wellbore and the rotor can be unlocked prior to drilling.

13. The turbine of claim 12 wherein said means for preventing rotational movement of said rotor relative to said turbine case comprises:

a locking assembly slidably mounted on said rotor coaxially therewith;

a splined connection formed between said locking assembly and said rotor, said connection permitting relative axial movement of said locking assembly and said rotor while restricting relative rotational movement thereof;

a tab fixedly mounted on said locking assembly and extending radially outwardly therefrom;

an axial groove formed on the inner surface of said turbine case, said groove preventing rotation of said locking assembly relative to said turbine case when said tab is received in said axial groove; and an annular cavity formed on the inner surface of said turbine case adjacent one end of said groove, said cavity permitting rotation of said locking assembly relative to said turbine case when said tab is received in said annular cavity.

14. The turbine of claim 13 wherein said turbine further includes means for biasing said locking assembly toward a position in which said tab is received in said axial groove.

15. The turbine of claim 13 wherein said turbine further includes means for fixing said locking assembly in a first axial position relative to said rotor in which said tab is received in said axial groove.

16. The turbine of claim 15 wherein said means for fixing said locking assembly in a first axial position relative to said rotor comprises a shear pin received through radial bores in said rotor and said locking assembly.

17. The turbine of claim 15 wherein said turbine further includes means for fixing said locking assembly in a second axial position relative to said rotor in which said tab is received in said annular cavity.

18. The turbine of claim 17 wherein said means for fixing said locking assembly in a second axial position relative to said rotor comprises snap ring means disposed between said locking assembly and said rotor.

19. The turbine of claim 17 wherein said turbine further includes means for biasing and locking assembly toward its second axial position.

20. The turbine of claim 13 wherein said locking assembly includes a generally cylindrical upper portion which substantially spans the interior of said turbine case and a bore therethrough which permits fluid communication between said interior cavity above said locking assembly and said interior cavity below said locking assembly.

21. The turbine of claim 13 wherein said turbine further includes means for biasing said locking assembly toward a position in which said tab is received in said axial groove.

* * * * *